US005887239A

United States Patent [19]

Hong et al.

[11] Patent Number: 5,887,239

[45] Date of Patent: Mar. 23, 1999

[54] IMAGE-RELATED DEVICE HAVING IMAGE-MEDIUM RECEIVING TRAY, AND A TRAY FOR SAME, AND A METHOD FOR DESIGNING SUCH TRAY

[75] Inventors: Juehui Hong, San Diego; Caroline Zepeda, San Marcos; Michael Kennedy, San Diego, all of Calif.

[73] Assignee: Hewlett-Packard Company, Palo Alto, Calif.

[21] Appl. No.: 706,032

[22] Filed: Aug. 30, 1996

[51] Int. Cl.[6] ..... G03G 15/00

[52] U.S. Cl. ..... 399/405; 271/161

[58] Field of Search ..... 399/405; 271/161, 271/209; 364/474.24, 474.29

[56] References Cited

U.S. PATENT DOCUMENTS 4,619,450 10/1986 Anderson et al. ..... 271/161 X 5,419,548 5/1995 Ueda et al. ..... 271/209 X

*Primary Examiner*—S. Lee

[57] ABSTRACT

An image-related device has an image-medium receiving tray. The tray is designed by a method that enables the tray to control the contouring of sheets of image medium during reception. The tray has a planar surface and a curved surface. The curved surface is designed by selecting a series of transverse and longitudinal curves to define a curved surface that is generally concave in the transverse direction while also sloping upward in the longitudinal direction. The combined concave and sloped shape of the curved surface causes the leading-edge region of the image medium to transversely curl and thereby obtain sufficient rigidity to extend beyond the front end of the tray. In addition, the curved surface—operating in conjunction with the kickout mechanism of the device—interacts with sheets of medium in a way that causes the sheets to land on top of each other instead of sliding against each other, thereby reducing the possibility of smearing while at the same time producing a neat, evenly stacked pile of media.

19 Claims, 5 Drawing Sheets

FIG. 4
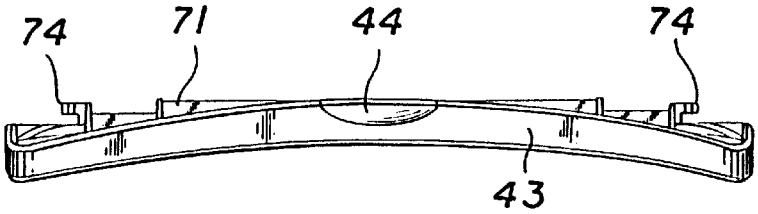
FIG. 3
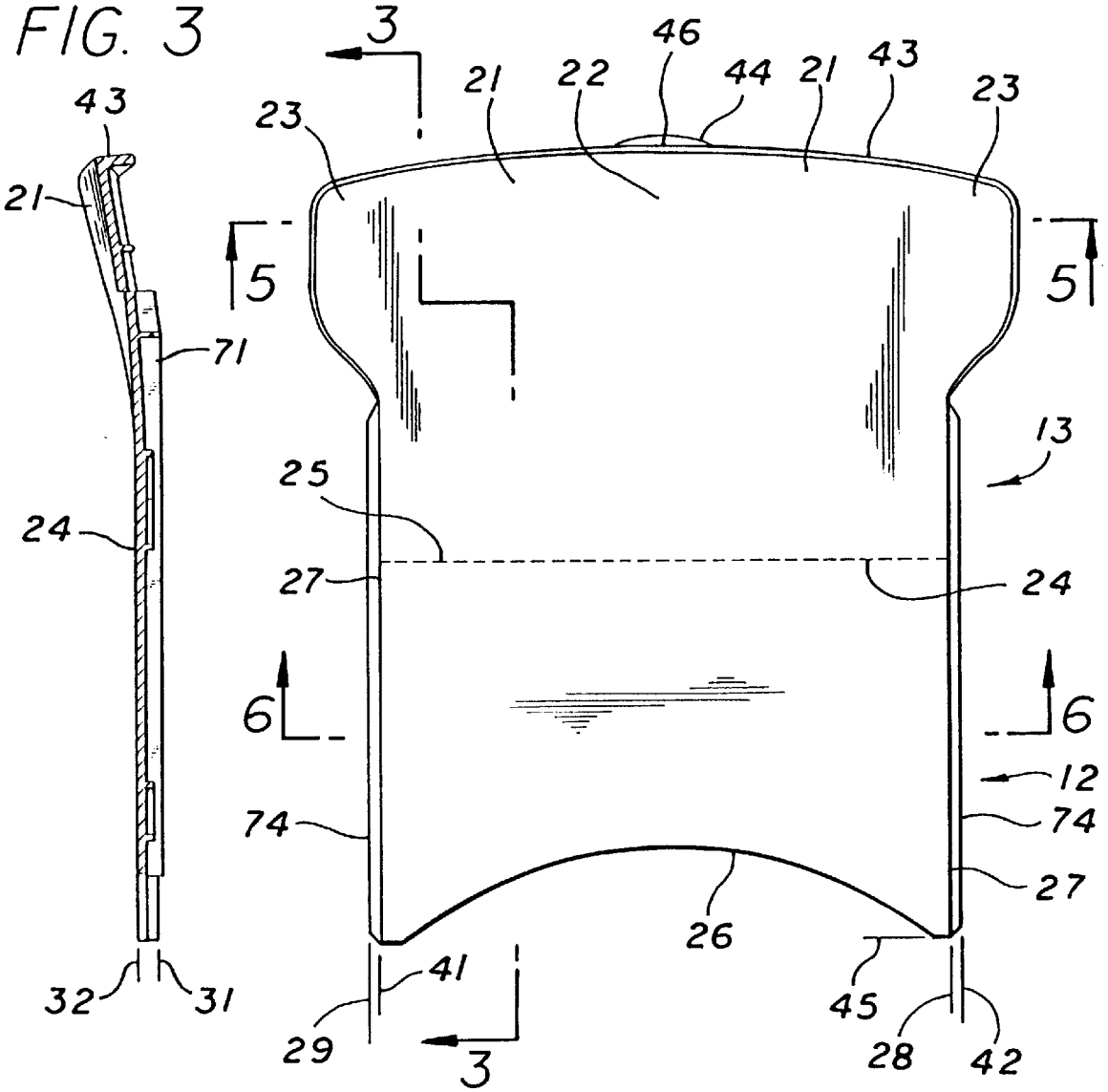
FIG. 2

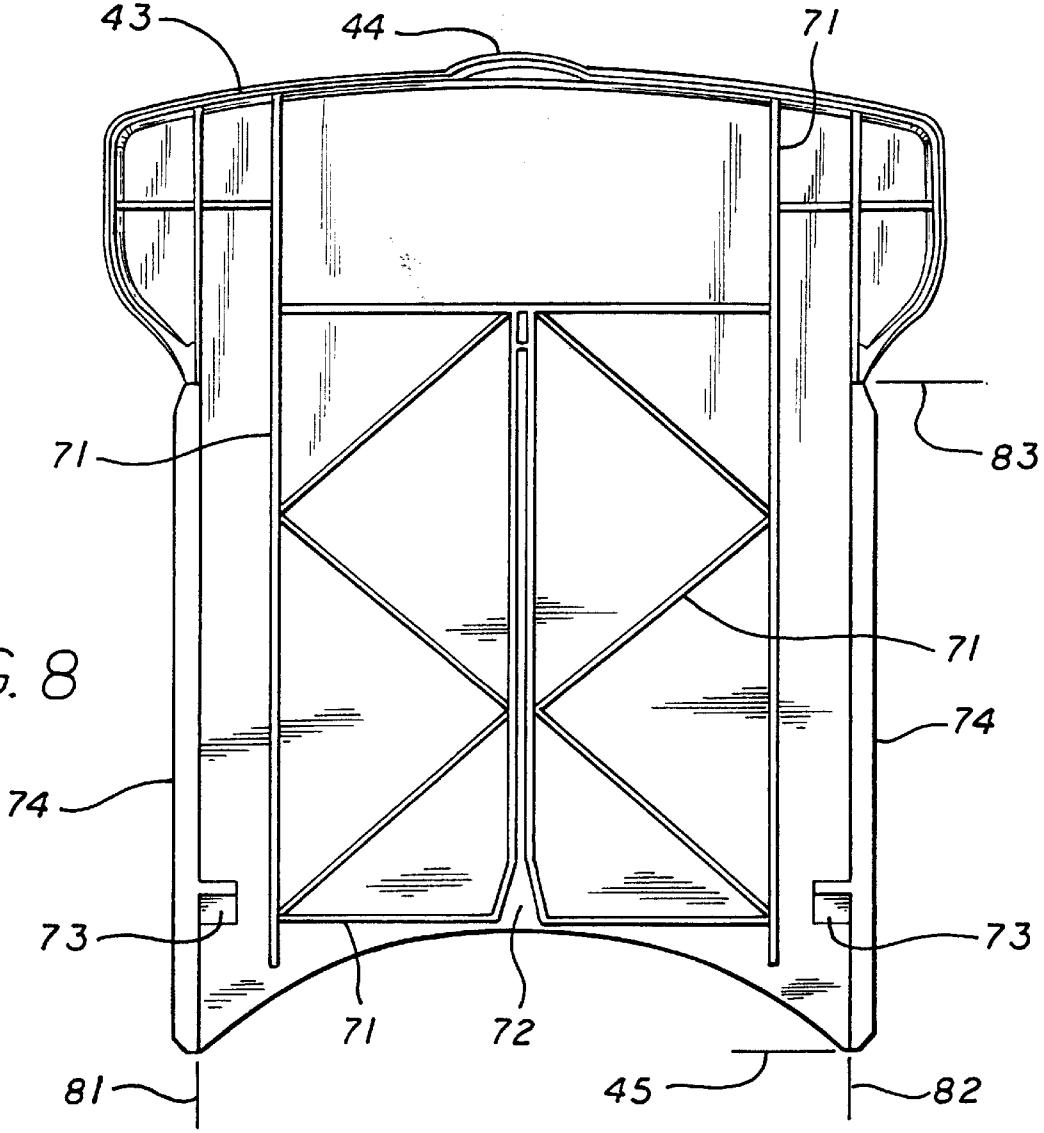
FIG. 8
FIG. 9
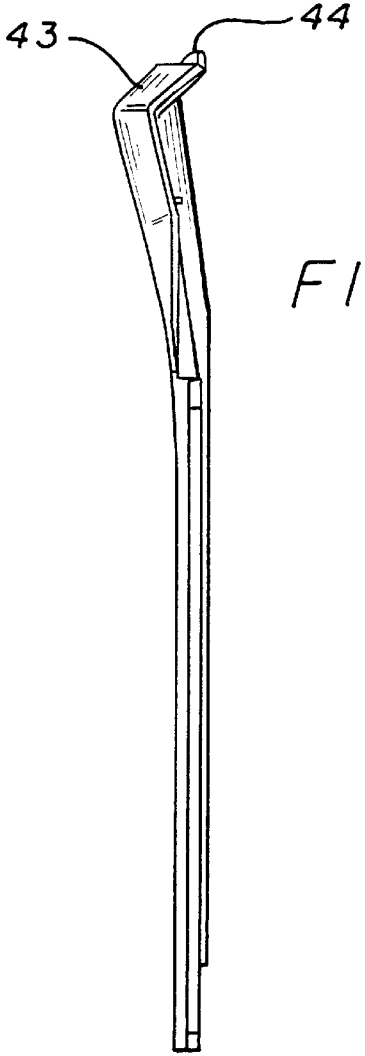

IMAGE-RELATED DEVICE HAVING IMAGE-MEDIUM RECEIVING TRAY, AND A TRAY FOR SAME, AND A METHOD FOR DESIGNING SUCH TRAY

FIELD OF THE INVENTION

This invention relates generally to the way sheets of image medium are collected and to apparatus that controls the collection of sheets; and more specifically to an image-related device having an image-medium receiving tray, and to a tray for receiving image medium, and to a method for designing a tray that controls the contouring of sheets during reception.

Throughout this document the term image medium refers to a medium such as paper or transparency that either carries an image, i.e. an image-bearing medium, or is capable of having an image formed on it, i.e. printing medium. Similarly the term image-related device is hereby defined as encompassing both (1) a device that forms an image on image medium—such as a printer, copier, or a facsimile (FAX) machine in the receiving mode—and (2) a device that senses an image on an image-bearing medium and produces a corresponding electrical signal—such as a scanner or a FAX machine in the sending mode. Thus "image-related device" for present purposes is essentially synonymous with "hard-copy apparatus".

BACKGROUND OF THE INVENTION

The functionality of an image-related device is greatly enhanced when it is able to consistently provide the user with neat and usable output. The image-medium receiving tray of a device plays a crucial role in providing such enhancement.

An effective tray must be able to collect media of different sizes and types and do so in a manner that does not disturb, e.g. smear, the image. To be even more effective a tray should evenly stack the medium it collects.

To be all of the above, a tray must be designed with consideration given to the operating parameters of the associated image-related device. For example, the type of device determines the type and size of medium that the tray must handle—thereby affecting the size of the tray.

The device also defines the speed and angle at which the tray receives the medium—thereby also affecting the size, the angle at which the tray interfaces with the device, and possibly the shape of the tray. Current techniques of tray design are discussed below within the context of several design considerations.

(a) Size of image medium—Most devices process image medium of different sizes; accordingly the tray must be able to accommodate the same variety of sizes. To fulfill this requirement many devices simply use a large tray to handle the largest possible medium that the device can output.

It is desirable, however, that the device and tray be both compact and economical. These characteristics are preferably obtained by reducing the overall size of the tray and accommodating larger medium in other ways.

When the leading-edge portion of a sheet of medium curls downward relative to the trailing-edge portion of the medium—a phenomenon familiarly known as "flopping"—the system may lose control of the medium. In particular with a short tray, large medium flops over the front end of the tray (i.e., the end farthest from other components of the image-related device) and may completely slide over and off the front end of the tray.

One mechanism for accommodating large medium and preventing flopping is a multipiece tray. A multipiece tray includes a main tray and an extension tray—mechanically attached to the main tray and usually stowed beneath or within the main tray. The extension tray is extended to create, in combination with the main tray, a tray large enough to collect large medium.

Though adequate to accommodate large medium and prevent flopping, a multipiece tray is undesirable for several reasons. First, repeated extension and retraction of the extension tray and the stress it places on the mechanism joining the trays results in a device which is susceptible to breakage. Second, multipiece trays are a significant inconvenience to the user, who must repeatedly extend and retract the extension tray to accommodate various media.

Third, an extension tray and the associated mechanical attachments increase the amount of material required to produce the tray and thereby increase overall cost. Finally, when extended the extension tray creates a discontinuous and rough surface over which sheets of medium must slide. This discontinuity often causes sheets to slide erratically, resulting in an uneven stack of medium.

A second technique to accommodate larger medium is to transversely curl the medium along its entire length. This is usually implemented through use of a cylindrical-surface tray. Such a tray forces the medium to transversely curl—thereby giving rigidity to the medium. With this rigidity the medium can extend over the front end of the tray without flopping. A beneficial feature of this technique is that it operates relatively independently of the size of the tray. Though somewhat appealing, this technique is undesirable under certain operating conditions as explained below.

(b) Type of image processing—Another operating parameter to be considered when designing a tray is the type of image processing the device performs. An effective tray must collect and stack image medium in a manner that does not disturb the image just processed by the device. For example, in a liquid-ink device a sheet having wet ink is likely to smear when a subsequent sheet contacts it. One method of avoiding image disturbance in such a context is taught in U.S. Pat. No. 5,299,875 of Hock et al.

In Hock et al. a set of wing deflectors positioned near the exit slot of a portable inkjet printer imparts a W-shaped bow on the leading-edge portion of an emerging sheet. This bow imparts rigidity to the leading-edge portion—which allows it to extend over and above the output platform of the printer and the trailing edge of any already-dropped sheet or sheets at rest on the platform.

As the sheet continues to emerge, however, and the leading-edge portion of the sheet moves farther from the deflectors it begins to lose rigidity. When the trailing edge of the sheet exits the printer, the leading-edge portion completely loses rigidity and flops onto the already-dropped sheet—making initial contact toward the leading edge of the sheet. The trailing-edge portion, still bowed by the deflectors, remains at rest on top of the deflectors—separate from the already-dropped sheet.

When a subsequent emerging sheet contacts the bowed trailing edge of the previously exited (but not yet completely dropped) sheet it pushes the trailing edge forward past the deflectors. The trailing-edge portion loses its rigidity and falls onto the trailing-edge portion of the already-dropped sheet.

In limiting the initial contact between the sheets to their leading-edge portions, this device reduces the possibility of smearing since the leading-edge portion of the already-dropped sheet is driest. Also, in keeping the trailing-edge portions of printed sheets separate until a subsequent sheet begins to emerge, this device allows more time for the trailing-edge portion of the already-dropped sheet to dry before another sheet lands on top of it.

While generally effective in preventing smearing this technique is somewhat undesirable because it curls the medium immediately upon exiting the device—thereby curling the medium while the ink is wettest. Because the medium is curled while the ink is drying, the medium is likely to have a residual curl.

In addition, while Hock et al. teach a relevant principle, their implementation of the principle is in a portable ink-jet printer which does not use a tray to collect its output; it merely drops its output onto a table. Such operation is outside the field of the present invention as defined above, and undesirable in a printer intended for essentially fixed installation—as table space is assumed to be at a premium, and a printer is commonly positioned with its tray extending over the table edge (except when not in use and stowed within the printer).

(c) Stacking of image medium—A common problem associated with trays is uneven stacking of sheets of image medium. This problem occurs when sheets ejected from a device slide in a disorderly fashion on the tray surface and particularly on previously deposited sheets.

The result is a pile of misaligned or sometimes even scattered sheets. The user has no option but to manually even the edges of the medium.

A factor contributing to uneven stacking is the manner in which the tray receives the medium from the device. Some typical devices have their trays positioned so that the leading edge of each sheet of medium slides from the back of the tray (i.e., the end closest to other components of the image-related device) toward the front. While sliding, the medium encounters resistance and discontinuities in the tray surface or resistance from previously deposited medium. This resistance sometimes causes the medium to move erratically.

A common technique to achieve even stacking is to add stops at the front end or along the sides of the tray, or both. As with the multipiece tray design previously mentioned, such mechanical additions to the tray are inconvenient, costly, and susceptible to breakage.

Another mechanism for even stacking in inkjet devices uses a pair of longitudinally extending wings driven by an electromechanical assembly. The wings initially hold a newly printed sheet spaced above a previously printed sheet. After printing is complete, the wings move apart, allowing the printed sheet to drop onto the previously printed sheet.

Therefore the sheets fall into an orderly stack. Though quite effective in stacking medium, this mechanism may be relatively more costly.

(d) Summary of related techniques—As previously stated, common techniques for designing effective trays generally include the use of a simple planar surface with various mechanical additions such as extensions and stops. More sophisticated designs have used cylindrical surfaces to control the shape of the medium or electromechanical wings to control the placement of medium.

These techniques, while providing trays that enhance device functionality, create problems in other areas. For example, transverse curling of wet medium—either by deflectors or by a cylindrical surface—causes the medium to have a residual curve. The use of a multipiece tray creates surface discontinuities which may cause uneven stacking of medium. A final problem is that the trays produced by some of these techniques—with their extensions and stops or electromechanical wings—are economically inefficient.

(e) Previously unrelated techniques—In a field not previously associated with the interaction between trays and solid but very flexible image media, it is known to use B-spline curves to design surfaces. Such surface design is common in the automotive and aerospace industries, where the interaction between surfaces and fluids is closely scrutinized to optimize machine performance and efficiency. Such techniques are also common in the field of industrial design, where they are used in shaping common household products to help find aesthetically pleasing forms.

As previously stated, the B-spline surface design technique has not been previously associated with, or suggested for use in, the functional design of image-medium receiving trays.

(f) Conclusion—Thus important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first facet or aspect, the invention is an image-medium receiving tray for collecting and stacking sheets of image medium from an image-related device. The image-related device includes at least one of a printer, copier, scanner or FAX machine.

The image-medium receiving tray includes a curved surface having a longitudinal central region, two side regions, and a boundary. The side regions substantially smoothly curve upward from the central region in the lateral direction and upward from the boundary in the longitudinal direction. The substantially smoothly curved surface may have relatively small or minor surface disruptions, such as cavities or through-holes, that do not affect the behavior of the sheets.

The tray also includes some means for linking the curved surface to the image-related device. For purposes of generality and breadth in expressing the invention these means will be called simply "the linking means".

The foregoing may constitute a description or definition of the first facet of the invention in its broadest or most general form. Even in this general form, however, it can be seen that this aspect of the invention significantly mitigates the difficulties left unresolved in the art.

In particular, the combined transverse and longitudinal curves of the surface ensure that the leading-edge portion of the image medium is transversely curled to provide sufficient rigidity to extend beyond the front end of the tray. In addition, the curved surface interacts with sheets of medium in a way that causes the sheets to land on top of each other instead of sliding against each other and thereby reduces the possibility of smearing—a particularly beneficial feature when the tray is used in conjunction with a liquid-ink device. Also, the controlled interaction between the curved surface and the sheets results in a neat, evenly stacked pile of media.

For these benefit to be fully realized the tray preferably operates in conjunction with other elements of the device so that the leading-edge portion of an exiting sheet reaches the elevated region of the curved surface before the trailing edge reaches the lower region of the curved surface. These "other elements" are detailed later in this document.

An already-exited sheet, at rest on the tray, has a leading-edge portion on the elevated region of the curved surface and a trailing-edge portion on the lower region of the curved surface. As a sheet emerges from the device it extends over and above the trailing-edge portion of the already-exited sheet and makes initial contact with the leading-edge portion of the already-exited sheet.

The trailing-edge portion of the just-exited sheet then lands, most typically floating down gently, on the trailing-edge portion of the already-exited sheet. Thus the just-exited sheet comes to rest on top of the already-exited sheet without sliding along the sheet—thereby reducing the possibility of smearing while at the same time resulting in a even stack of sheets.

In Hock et al., as previously described, a similar concept is used to prevent smearing. That concept, however, is employed in a device structurally very distinct from our tray—and, as will be seen shortly, the compound curves of the present invention impart benefits far beyond those of the Hock system.

Although this aspect of the invention in its broad form thus represents a significant advance in the art, it is preferably practiced in conjunction with certain other features or characteristics that further enhance enjoyment of overall benefits.

For example, it is preferred that the linking means include a generally planar surface having a boundary and naturally some mechanical device to couple the tray with the image-related device. It is also desirable that the planar surface and the curved surface substantially smoothly blend together at their respective boundaries. By "blend" we mean a continuous transition between the planar and shaped surfaces.

It is also preferred that the combined longitudinal length of the curved surface and the planar surface be shorter than letter-size paper and that the curved surface and the planar surface be for supporting sheets of image medium. It is further desirable that the image-medium receiving tray comprise no other means for supporting such sheets.

It is further preferred that the lateral widths of the planar surface and curved surface be narrower than letter-size paper. By "letter-size paper" we mean paper having dimensions about 22 by 28 cm (8½ by 11 inches).

These small dimensions are possible because of the gently curved surface of the tray which imparts rigidity on the medium so that it can extend beyond the front end of the tray, i.e., the end remote from the device. Remarkably, our letter-size tray is able to support legal-size medium, having dimensions of about 22 by 36 cm (8½ by 14 inches)—without flopping and also without residual curl.

It is yet further preferred that the image-medium receiving tray have no longitudinal image-medium stop. It is still further preferred that the planar surface have a maximum width and that the curved surface further comprise two corners substantially smoothly curving upward from their respective side regions in a lateral direction, and extending laterally beyond the maximum width of the planar surface.

In preferred embodiments of a second independent aspect or facet, the invention is an image-medium receiving tray for collecting and stacking sheets of image medium from an image-related device that comprises at least one of a printer, copier, scanner or FAX machine. The image-medium receiving tray includes a curved surface defined substantially by the following equations in conjunction with Table 1:

$$\underline{Q}(\underline{u}, \underline{v}) = \sum_{i=0}^{n-1} \sum_{j=0}^{m-1} \underline{v}_{i,j} \underline{S}_{i,j}(\underline{u}, \underline{v}) \quad \text{(Eq. 1)}$$

where:

$\underline{V}_{i,j}$ are the coordinates of the control vertices;

$$\underline{S}_{i,j}(\underline{u}, \underline{v}) = \frac{\underline{w}_{i,j} \underline{N}_{i,k}(\underline{u}) \underline{N}_{j,l}(\underline{v})}{\sum_{i=0}^{n-1} \sum_{j=0}^{m-1} \underline{w}_{i,j} \underline{N}_{i,k}(\underline{u}) \underline{N}_{j,l}(\underline{v})}, \quad \text{(Eq. 2)}$$

$\underline{w}_{i,j}$ being a weight function;

$$\underline{N}_{i,k}(\underline{u}) = \frac{(\underline{u} - \underline{u}_i)\underline{N}_{i,k-1}(\underline{u})}{\underline{u}_{i+k-1} - \underline{u}_i} + \frac{(\underline{u}_{i+k} - \underline{u})\underline{N}_{i+1,k-1}(\underline{u})}{\underline{u}_{i+k} - \underline{u}_{i+1}} \quad \text{(Eq. 3)}$$

is the basis function in the $\underline{u}$ direction, where the first-order basis functions are:

$$\begin{aligned} \underline{N}_{i,1}(\underline{u}) &= 1 \text{ if } \underline{u}_i \leqq \underline{u} < \underline{u}_{i+1} \\ &= 0 \text{ otherwise} \end{aligned}$$

and having values of $\underline{u}$ in accordance with $$\underline{T}_{knot\ (u)} = [\underline{u}_{min}, \underline{u}_{min}, \ldots \underline{u}_{min}, \underline{u}_k \ldots \underline{u}_{M-\underline{k}-1}, \underline{u}_{max}, \underline{u}_{max} \ldots \underline{u}_{max}] \quad \text{(Eq. 4)}$$

where the total number of $\underline{u}$ values is $\underline{M}=\underline{k}+\underline{n}$, and the number of $\underline{u}_{min}$ and $\underline{u}_{max}$ is equal to $\underline{k}$;

$$\underline{N}_{j,1}(\underline{v}) = \frac{(\underline{v} - \underline{v}_j)\underline{N}_{j,l-1}(\underline{v})}{\underline{v}_{j+l-1} - \underline{v}_j} + \frac{(\underline{v}_{j+l} - \underline{v})\underline{N}_{j+1,l-1}(\underline{v})}{\underline{v}_{j+l} - \underline{v}_{j+1}} \quad \text{(Eq. 5)}$$

is the basis function in the $\underline{v}$ direction where the first-order basis functions are:

$$\begin{aligned} \underline{N}_{j,1}(\underline{v}) &= 1 \text{ if } \underline{v}_j \leqq \underline{v} < \underline{v}_{j+1} \\ &= 0 \text{ otherwise} \end{aligned}$$

and having values of $\underline{v}$ in accordance with $$\underline{T}_{knot(v)} = [\underline{v}_{min}, \underline{v}_{min}, \ldots \underline{v}_{min}, \underline{v}_l, \ldots \underline{v}_{M-l-1}, \underline{v}_{max}, \underline{v}_{max}, \ldots \underline{v}_{max}] \quad \text{(Eq. 6)}$$

where the total number of $\underline{v}$ values is $\underline{M}=l+\underline{m}$, and the number of $\underline{v}_{min}$ and $\underline{v}_{max}$ is equal to $\underline{l}$;

$\underline{n}$ is the number of control vertices in the $\underline{u}$ direction;

$\underline{m}$ is the number of control vertices in the $\underline{v}$ direction;

$\underline{k}$ is the order of the basis function in the $\underline{u}$ direction which is equal to the order of the B-spline in the $\underline{u}$ direction;

$\underline{l}$ is the order of the basis function in the $\underline{v}$ direction which is equal to the order of the B-spline in the $\underline{v}$ direction.

(In the computer-generated Table 1, the letter "D" indicates that the full data are being maintained to "double precision", the numbers actually tabulated here being only the first twelve digits. The following algebraic sign and final two digits represent the power of ten; thus the tabulation is essentially in scientific notation.)

The tray also includes means for linking the curved surface and image-related device—again, the "linking means".

TABLE 1

Curved Surface Definition

Surface type: open, nonperiodic, rational B-spline in both u and v directions

Order of B-spline:

u direction: k=5 v direction: l=4

Numbers of control vertices:

u direction: n=13 v direction: m=12

Knot vector, $T_{knot(u)}$, in u direction:

| | | |
|---|---|---|
| [−1.10045330958D+01, | −1.10045330958D+01, | −1.10045330958D+01, |
| −1.10045330958D+01, | −1.10045330958D+01, | 1.04593460712D+00, |
| 1.04593460712D+00, | 1.04593460712D+00, | 1.04593460712D+00, |
| 1.10045294954D+02, | 1.10045294954D+02, | 1.10045294954D+02, |
| 1.10045294954D+02, | 1.21049828049D+02, | 1.21049828049D+02, |
| 1.21049828049D+02, | 1.21049828049D+02, | 1.21049828049D+02] |

Knot vector, $T_{knot(v)}$, in v direction:

| | | |
|---|---|---|
| [−1.36399472686D+01, | −1.36399472686D+01, | −1.36399472686D+01, |
| −1.36399472686D+01, | 1.D+00, | 1.D+00, |
| 1.D+00, | 2.1D+01, | 2.1D+01, |
| 1.4225070206D+02, | 1.4225070206D+02, | 1.4225070206D+02, |
| 1.56422579271D+02, | 1.56422579271D+02, | 1.56422579271D+02, |
| 1.56422579271D+02] | | |

$w_{i,j}$ = 1.0 for all control vertices x, y, z coordinates of control vertices, $V_{i,j}$ in the u and v directions:

| i,j | x-axis | y-axis | z-axis |
|---|---|---|---|
| 0,0 | −1.12349933671D+01 | −1.38626377081D+01 | 5.56521174617D−02 |
| 1,0 | −8.62036451534D+00 | −1.38626377034D+01 | 5.56521174428D−02 |
| 2,0 | −5.88294348505D+00 | −1.38626376985D+01 | 5.56521174231D−02 |
| 3,0 | −3.01299212726D+00 | −1.38626376933D+01 | 5.56521174024D−02 |
| 4,0 | 0.D+00 | −1.38626376879D+01 | 5.56521173807D−02 |
| 5,0 | 2.72532338742D+01 | −1.3862637639D+01 | 5.56521171841D−02 |
| 6,0 | 5.45087993677D+01 | −1.38626222758D+01 | 8.1516786184D−02 |
| 7,0 | 8.17595984574D+01 | −1.38625736943D+01 | 1.34412485333D−01 |
| 8,0 | 1.08999360346D+02 | −1.38624620928D+01 | 2.10814121479D−01 |
| 9,0 | 1.11749476129D+02 | −1.38624508255D+01 | 2.18527600997D−01 |
| 10,0 | 1.14382330974D+02 | −1.38624400379D+01 | 2.25912544189D−01 |
| 11,0 | 1.16906547814D+02 | −1.38624296946D+01 | 2.32993110393D−01 |
| 12,0 | 1.19330115481D+02 | −1.3862419763D+01 | 2.39791682357D−01 |
| 0,1 | −1.12345873692D+01 | −9.51065047897D+00 | 3.81808893808D−02 |
| 1,1 | −8.62004432704D+00 | −9.51065047734D+00 | 3.81808893742D−02 |
| 2,1 | −5.88271903114D+00 | −9.51065047564D+00 | 3.81808893674D−02 |
| 3,1 | −3.01297411961D+00 | −9.51065047385D+00 | 3.81808893602D−02 |
| 4,1 | 0.D+00 | −9.51065047198D+00 | 3.81808893527D−02 |
| 5,1 | 2.72521664668D+01 | −9.510650455D+00 | 3.81808892845D−02 |
| 6,1 | 5.450593122D+01 | −9.51064512881D+00 | 5.59106840217D−02 |
| 7,1 | 8.17564286983D+01 | −9.51062828629D+00 | 9.21699114385D−02 |
| 8,1 | 1.08999360346D+02 | −9.5105895956D+00 | 1.44542550467D−01 |
| 9,1 | 1.11749796147D+02 | −9.5105856894D+00 | 1.49830071767D−01 |
| 10,1 | 1.14382940319D+02 | −9.51058194948D+00 | 1.54892370391D−01 |
| 11,1 | 1.16907418053D+02 | −9.51057836362D+00 | 1.59746008376D−01 |
| 12,1 | 1.19331220272D+02 | −9.51057492049D+00 | 1.64406329848D−01 |
| 0,2 | −1.12341580969D+01 | −4.90918015587D+00 | 1.97081013669D−02 |
| 1,2 | −8.61970578355D+00 | −4.90918015587D+00 | 1.97081013669D−02 |
| 2,2 | −5.88248171012D+00 | −4.90918015587D+00 | 1.97081013669D−02 |
| 3,2 | −3.01274934702D+00 | −4.90918015587D+00 | 1.97081013669D−02 |
| 4,2 | 0.D+00 | −4.90918015587D+00 | 1.97081013669D−02 |
| 5,2 | 2.72510378689D+01 | −4.90918015587D+00 | 1.97081013669D−02 |
| 6,2 | 5.45028986487D+01 | −4.90918015587D+00 | 2.88366488847D−02 |
| 7,2 | 8.17530772127D+01 | −4.90918015587D+00 | 4.75055155311D−02 |
| 8,2 | 1.08999360346D+02 | −4.90918015587D+00 | 7.44709588388D−02 |
| 9,2 | 1.11750134512D+02 | −4.90918015587D+00 | 7.71933795244D−02 |
| 10,2 | 1.14383584539D+02 | −4.90918015587D+00 | 7.97998313351D−02 |
| 11,2 | 1.16908338007D+02 | −4.90918015587D+00 | 8.22988421901D−02 |
| 12,2 | 1.19332388057D+02 | −4.90918015587D+00 | 8.4698312897D−02 |
| 0,3 | −1.12337025098D+01 | −2.56340649229D−02 | 1.02908817787D−04 |
| 1,3 | −8.61934648693D+00 | −2.56340649229D−02 | 1.02908817787D−04 |
| 2,3 | −5.88222984104D+00 | −2.56340649229D−02 | 1.02908817787D−04 |
| 3,3 | −3.01261692572D+00 | −2.56340649229D−02 | 1.02908817787D−04 |
| 4,3 | 0.D+00 | −2.56340649229D−02 | 1.02908817787D−04 |
| 5,3 | 2.72498400866D+01 | −2.56340649229D−02 | 1.02908817787D−04 |
| 6,3 | 5.44996801732D+01 | −2.56340649229D−02 | 1.02908817787D−04 |
| 7,3 | 8.17495202598D+01 | −2.56340649229D−02 | 1.02908817787D−04 |
| 8,3 | 1.08999360346D+02 | −2.56340649229D−02 | 1.02908817787D−04 |

TABLE 1-continued

| Curved Surface Definition | | | |
|---|---|---|---|
| 9,3 | 1.1175049362D+02 | −2.56340649229D−02 | 1.02908817787D−04 |
| 10,3 | 1.14384268193D+02 | −2.56340649229D−02 | 1.02908817787D−04 |
| 11,3 | 1.16909314186D+02 | −2.56340649229D−02 | 1.02908817787D−04 |
| 12,3 | 1.19333627094D+02 | −2.56340649229D−02 | 1.02908817787D−04 |
| 0,4 | −1.12330801207D+01 | 6.64590101828D+00 | −2.66802375822D−02 |
| 1,4 | −8.61885564277D+00 | 6.64590101828D+00 | −2.66802375822D−02 |
| 2,4 | −5.88188575636D+00 | 6.64590101828D+00 | −2.66802375822D−02 |
| 3,4 | −3.01243602166D+00 | 6.64590101828D+00 | −2.66802375822D−02 |
| 4,4 | 0.D+00 | 6.64590101828D+00 | −2.66802375822D−02 |
| 5,4 | 2.72482037661D+01 | 6.64590101828D+00 | −2.66802375822D−02 |
| 6,4 | 5.4495283333D+01 | 6.64590101828D+00 | −3.91509758304D−02 |
| 7,4 | 8.17446610171D+01 | 6.64590101828D+00 | −6.46549838761D−02 |
| 8,4 | 1.08999360346D+02 | 6.64590101828D+00 | −1.01493153868D−01 |
| 9,4 | 1.11750984208D+02 | 6.64590101828D+00 | −1.05212321206D−01 |
| 10,4 | 1.14385201127D+02 | 6.64590101828D+00 | −1.08772798227D−01 |
| 11,4 | 1.16910644774D+02 | 6.64590101828D+00 | −1.12186254425D−01 |
| 12,4 | 1.19335313929D+02 | 6.64590101828D+00 | −1.15463501165D−01 |
| 0,5 | −1.12324577316D+01 | 1.33174361015D+01 | −5.34633839821D−02 |
| 1,5 | −8.61836479862D+00 | 1.33174361015D+01 | −5.34633839821D−02 |
| 2,5 | −5.88154167167D+00 | 1.33174361015D+01 | −5.34633839821D−02 |
| 3,5 | −3.01225511759D+00 | 1.33174361015D+01 | −5.34633839821D−02 |
| 4,5 | 0.D+00 | 1.33174361015D+01 | −5.34633839821D−02 |
| 5,5 | 2.72465674456D+01 | 1.33174361015D+01 | −5.34633839821D−02 |
| 6,5 | 5.44908864928D+01 | 1.33174361015D+01 | −7.84048604786D−02 |
| 7,5 | 8.17398017743D+01 | 1.33174361015D+01 | −1.2941287657D−01 |
| 8,5 | 1.08999360346D+02 | 1.33174361015D+01 | −2.03089216554D−01 |
| 9,5 | 1.11751474795D+02 | 1.33174361015D+01 | −2.1052755123D−01 |
| 10,5 | 1.14386133783D+02 | 1.33174361015D+01 | −2.17648430712D−01 |
| 11,5 | 1.16911974548D+02 | 1.33174361015D+01 | −2.24475199474D−01 |
| 12,5 | 1.19336999175D+02 | 1.33174361015D+01 | −2.31029485321D−01 |
| 0,6 | −1.12412490209D+01 | 6.03322367293D+01 | 3.24850439254D−01 |
| 1,6 | −8.62529800672D+00 | 6.03322367293D+01 | 3.24850439254D−01 |
| 2,6 | −5.88640189201D+00 | 6.03322367293D+01 | 3.24850439254D−01 |
| 3,6 | −3.01481040023D+00 | 6.03322367293D+01 | 3.24850439254D−01 |
| 4,6 | 0.D+00 | 6.03322367293D+01 | 3.24850439254D−01 |
| 5,6 | 2.72696805877D+01 | 6.03322367293D+01 | 3.24850439254D−01 |
| 6,6 | 5.45529921693D+01 | 6.03322367293D+01 | 4.76059016034D−01 |
| 7,6 | 8.18084389196D+01 | 6.03322367293D+01 | 7.85296904122D−01 |
| 8,6 | 1.08999360346D+02 | 6.03322367293D+01 | 1.23196230153D+00 |
| 9,6 | 1.11744545215D+02 | 6.03322367293D+01 | 1.27705746661D+00 |
| 10,6 | 1.4372934058D+02 | 6.03322367293D+01 | 1.32023402281D+00 |
| 11,6 | 1.1689311562D+02 | 6.03322367293D+01 | 1.36163305747D+00 |
| 12,6 | 1.1931304706D+02 | 6.03322367293D+01 | 1.40138528292D+00 |
| 0,7 | −1.13174220152D+01 | 1.00153301332D+02 | 3.60278792401D+00 |
| 1,7 | −8.68537147299D+00 | 1.00153301332D+02 | 3.60278792401D+00 |
| 2,7 | −5.9285137511D+00 | 1.00153301332D+02 | 3.60278792401D+00 |
| 3,7 | −3.03695089901D+00 | 1.00153301332D+02 | 3.60278792401D+00 |
| 4,7 | −2.84217094304D−14 | 1.00153301332D+02 | 3.60278792401D+00 |
| 5,7 | 2.74699466907D+01 | 1.00153301332D+02 | 3.60278792401D+00 |
| 6,7 | 5.50911523867D+01 | 1.00156220597D+02 | 5.28061822883D+00 |
| 7,7 | 8.24031522442D+01 | 1.00153301332D+02 | 8.71089013821D+00 |
| 8,7 | 1.08999360346D+02 | 1.00153301332D+02 | 1.36661079097D+01 |
| 9,7 | 1.11684503189D+02 | 1.00153301332D+02 | 1.41663847717D+01 |
| 10,7 | 1.14256179668D+02 | 1.00153301332D+02 | 1.46455213817D+01 |
| 11,7 | 1.16722733676D+02 | 1.00153301332D+02 | 1.5105072315D+01 |
| 12,7 | 1.19091895528D+02 | 1.00153301332D+02 | 1.55464778293D+01 |
| 0,8 | −1.13935950095D+01 | 1.39974365935D+02 | 6.88072540876D+00 |
| 1,8 | −8.74544493927D+00 | 1.39974365935D+02 | 6.88072540876D+00 |
| 2,8 | −5.97062561019D+00 | 1.39974365935D+02 | 6.88072540876D+00 |
| 3,8 | −3.0590913978D+00 | 1.39974365935D+02 | 6.88072540876D+00 |
| 4,8 | −5.68434188608D−14 | 1.39974365935D+02 | 6.88072540876D+00 |
| 5,8 | 2.76702127936D+01 | 1.39974365935D+02 | 6.88072540876D+00 |
| 6,8 | 5.56292337052D+01 | 1.39974365935D+02 | 1.00844730529D+01 |
| 7,8 | 8.29978655687D+01 | 1.39974365935D+02 | 1.66364833723D+01 |
| 8,8 | 1.08999360346D+02 | 1.39974365935D+02 | 2.61002535178D+01 |
| 9,8 | 1.11624461163D+02 | 1.39974365935D+02 | 2.70557120769D+01 |
| 10,8 | 1.14135370589D+02 | 1.39974365935D+02 | 2.79696083689D+01 |
| 11,8 | 1.16540485934D+02 | 1.39974365935D+02 | 2.88449987282D+01 |
| 12,8 | 1.18847586609D+02 | 1.39974365935D+02 | 2.96847147377D+01 |
| 0,9 | −1.14024981688D+01 | 1.44628683217D+02 | 7.26385331443D+00 |
| 1,9 | −8.75246637315D+00 | 1.44628683217D+02 | 7.26385331443D+00 |
| 2,9 | −5.97554767732D+00 | 1.44628683217D+02 | 7.26385331443D+00 |
| 3,9 | −3.06167919667D+00 | 1.44628683217D+02 | 7.26385331443D+00 |
| 4,9 | −5.68434188608D−14 | 1.44628683217D+02 | 7.26385331443D+00 |
| 5,9 | 2.76936200528D+01 | 1.44628683217D+02 | 7.26385331443D+00 |
| 6,9 | 5.5692133634D+01 | 1.44628975598D+02 | 1.06460278137D+01 |
| 7,9 | 8.30673761288D+01 | 1.44628683217D+02 | 1.75628329293D+01 |

TABLE 1-continued

| Curved Surface Definition | | | |
|---|---|---|---|
| 8,9 | 1.08999360346D+02 | 1.44628683217D+02 | 2.75535662145D+01 |
| 9,9 | 1.11617443404D+02 | 1.44628683217D+02 | 2.85622267676D+01 |
| 10,9 | 1.14120891298D+02 | 1.44628683217D+02 | 2.95265969551D+01 |
| 11,9 | 1.16518133874D+02 | 1.44628683217D+02 | 3.04499337257D+01 |
| 12,9 | 1.18816981073D+02 | 1.44628683217D+02 | 3.13352545239D+01 |
| 0,10 | −1.14109330895D+01 | 1.49038228621D+02 | 7.62683241393D+00 |
| 1,10 | −8.75911853282D+00 | 1.49038227948D+02 | 7.62683235856D+00 |
| 2,10 | −5.98021088103D+00 | 1.49038227243D+02 | 7.62683230051D+00 |
| 3,10 | −3.06413089693D+00 | 1.49038226502D+02 | 7.62683223956D+00 |
| 4,10 | −7.1054273576D−14 | 1.49038225724D+02 | 7.62683217548D+00 |
| 5,10 | 2.77157962677D+01 | 1.49038218683D+02 | 7.62683159589D+00 |
| 6,10 | 5.57516944506D+01 | 1.49036490171D+02 | 1.11777718206D+01 |
| 7,10 | 8.31330969077D+01 | 1.49029242736D+02 | 1.8438677036D+01 |
| 8,10 | 1.08999360346D+02 | 1.49014557007D+02 | 2.89230573084D+01 |
| 9,10 | 1.11610808259D+02 | 1.49013074341D+02 | 2.99815562696D+01 |
| 10,10 | 1.1410720076D+02 | 1.49011662008D+02 | 3.09931934262D+01 |
| 11,10 | 1.16496998595D+02 | 1.49010314835D+02 | 3.19614148206D+01 |
| 12,10 | 1.1878804034D+02 | 1.49009028032D+02 | 3.28894130863D+01 |
| 0,11 | −1.14189537839D+01 | 1.53231237187D+02 | 7.97198692175D+00 |
| 1,11 | −8.76544401498D+00 | 1.53231235247D+02 | 7.97198676204D+00 |
| 2,11 | −5.98464508185D+00 | 1.53231233213D+02 | 7.97198659458D+00 |
| 3,11 | −3.0664621979D+00 | 1.53231231077D+02 | 7.97198641876D+00 |
| 4,11 | −8.52651282912D−14 | 1.53231228831D+02 | 7.97198623392D+00 |
| 5,11 | 2.77368834421D+01 | 1.5323120852D+02 | 7.97198456199D+00 |
| 6,11 | 5.58083015777D+01 | 1.53225431018D+02 | 1.16831460293D+01 |
| 7,11 | 8.3195465066D+01 | 1.53205316077D+02 | 1.92698416205D+01 |
| 8,11 | 1.08999360346D+02 | 1.53162952924D+02 | 3.02183958282D+01 |
| 9,11 | 1.11604511594D+02 | 1.53158675957D+02 | 3.13237576097D+01 |
| 10,11 | 1.14094207424D+02 | 1.53154602417D+02 | 3.23798233212D+01 |
| 11,11 | 1.16476937998D+02 | 1.53150717345D+02 | 3.3390218012D+01 |
| 12,11 | 1.18760569142D+02 | 1.53147006882D+02 | 3.4358300159D+01 |

The foregoing may constitute a description or definition of the second facet of the invention in its broadest or most general form. Even in this general form, however, it can be seen that this aspect of the invention too significantly mitigates the difficulties left unresolved in the art.

In particular these equations, with their specified coefficients, define a highly optimized curved surface for controlling the behavior of sheets of image medium. These equations and coefficients represent the best implementation of the invention found so far.

Of course a reasonable range of tolerances for the coefficients is to be accepted without significantly altering the overall functionality of the tray, and therefore is encompassed within the term "substantially" above. A tray as so defined is accordingly within the scope of the corresponding appended claims.

In preferred embodiments of a third aspect, the invention is an image-related device for handling sheets of image medium and for incrementally scanning images thereon or forming images thereon, or both. The device includes some means for processing an image on each sheet, which again for purposes of generality will be called simply the "image-processing means".

The invention also includes some means for sequentially supplying multiple sheets to the image-processing means. We call these means the "supplying means". The device further includes a kickout mechanism for removing sheets from the image-processing means.

Also included is an image-medium receiving tray for receiving sheets from the kickout mechanism and collecting and stacking the sheets. The tray includes means for transversely curling a leading-edge portion of each sheet, and means for flattening a trailing-edge portion of each sheet. We call these means the "curling means" and "flattening means" respectively.

The foregoing may constitute a description or definition of the third facet of the invention in its broadest or most general form. Even in this general form, however, it can be seen that this aspect of the invention too significantly mitigates the difficulties left unresolved in the art.

In particular, the image-medium receiving tray acts in concert with the other elements of the image-related device to form a functionally enhanced device that collects and stacks its final output in a manner that does not disturb the image on the medium. In addition, the device collects an evenly stacked pile of medium.

Although this third aspect of the invention in its broad form thus represents a significant advance in the art, it is preferably practiced in conjunction with certain other features or characteristics that further enhance enjoyment of overall benefits.

For example, it is preferred that the image-processing means comprise wet-process means for forming images on each such sheet by aggregation of liquid ink. It is also preferred that the image-medium receiving tray be positioned and oriented relative to the kickout mechanism so that the curling means intercept the leading-edge portion of each sheet first and thereafter the flattening means receive the trailing-edge portion of each sheet.

As previously mentioned, this feature of the leading-edge portion of the medium reaching the curling means first is particularly powerful in printing machines that use liquid ink. For this feature to be realized it is important that the kickout mechanism of the device cooperate with the tray.

By "kickout mechanism" we mean those mechanisms located within the device which drive sheets of medium toward the tray at a specified angle and velocity. Such mechanisms typically include a set of engaging motorized rollers or wheels. The angle and velocity of the exiting medium are set so that the leading-edge portion of the medium reaches the curling means before the trailing edge reaches the flattening means.

In preferred embodiments of a fourth aspect or facet, the invention is a method for designing an image-medium receiving tray that will control the contouring and reception of image-medium sheets from an image-related device. The design method includes the step of establishing a set of transverse curves and a set of longitudinal matchline curves to generally define a part of the tray surface.

In this method, the transverse curves and longitudinal matchline curves are at least quadratic B-splines. The method also includes the step of interconnecting adjacent ones of the transverse curves along paths of the longitudinal matchline curves to further define the part of the tray surface.

The foregoing may constitute a description or definition of the fourth facet of the invention in its broadest or most general form. Even in this general form, however, it can be seen that this aspect of the invention too significantly mitigates the difficulties left unresolved in the art.

In particular, the design method uses B-spline curves to define the tray surface so that the interaction between the image medium and the surface may be more precisely defined and the behavior of the medium better controlled. This method extends the use of known design techniques—commonly associated with the field of fluid mechanics—into an area of solid-but-very-flexible-medium mechanics, with which such techniques have not been previously associated.

Although this fourth aspect of the invention in its broad form thus represents a significant advance in the art, it is preferably practiced in conjunction with certain other features or characteristics that further enhance enjoyment of overall benefits.

For example, it is preferred that the transverse curves and longitudinal matchline curves be adjusted to further define the part of the surface as curved, for curling a leading-edge portion of each sheet to give the leading-edge portion sufficient rigidity for extending beyond the front end of the tray (i.e., the end farthest from the other components of the image-related device). At the same time it is preferred that the transverse curves and longitudinal matchline curves be adjusted to restrain both the tightness and longitudinal extent of the curling so that the image medium is not strongly curled where it is wettest, and so tends not to retain a residual curl. This adjustment is particularly relevant for a tray that is to be used with an image-related device that operates using a wet process.

It is also desirable that a generally planar part of the tray surface be defined for flattening a trailing-edge portion of each sheet. It is further preferred that the transverse curves and longitudinal matchline curves be further adjusted so that for a specified initial height and velocity of the sheet, the curved surface intercepts the leading-edge portion of the sheet first and thereafter the planar surface receives the trailing-edge portion of the sheet.

All of the foregoing operational principles and advantages of the present invention will be more fully appreciated upon consideration of the following detailed description, with reference to the appended drawings, of which:

BRIEF DESCRIPTION OF THE DRAWINGS

FIG. 2 is a plan of the top surface of the FIG. 1 embodiment showing the curved surface and the planar surface;

FIG. 3 is a sectional elevation of the FIG. 1 embodiment taken along line 3—3 of FIG. 2 to show the longitudinal upward slope of the curved surface;

FIG. 4 is an elevation of the FIG. 1 embodiment showing the front end of the tray and the transverse curve of the curved surface;

FIG. 8 is a plan of the bottom surface of the FIG. 1 embodiment; and

FIG. 9 is an elevation of the FIG. 1 embodiment showing the side of the tray.

DETAILED DESCRIPTION OF THE PREFERRED EMBODIMENTS

Figure 1:
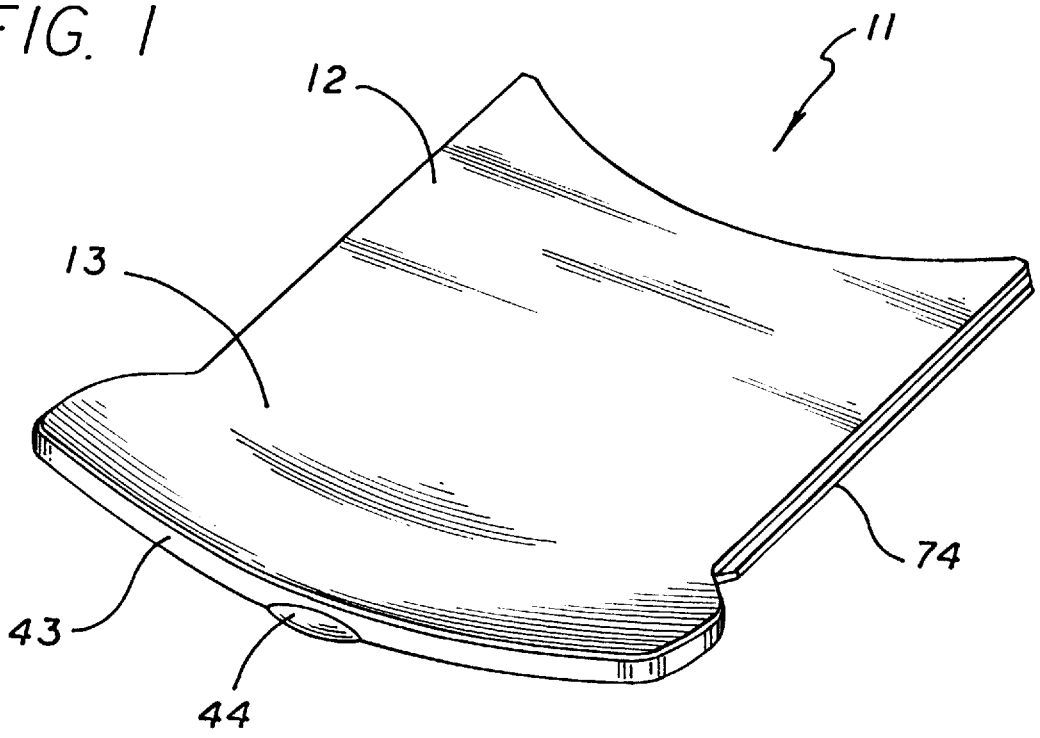
FIG. 1 is a perspective view of the top surface of an image-medium receiving tray that is a preferred embodiment of the invention.

Preferred embodiments of our invention provide an image-related device which includes a one-piece image-medium receiving tray (FIG. 1), and a tray for such a device. The tray interacts with sheets of medium from the other components of the device, in a way that allows the device to collect and neatly stack the sheets without disturbing the images on the sheets.

As previously mentioned, for the device to function in this manner certain elements of the device must cooperate—specifically the kickout mechanism and the tray. In addition, the operating parameters (e.g. image-medium size and image processing type) of the associated device must be taken into account when designing the tray.

Following is a physical description of a preferred embodiment of our image-related device and tray.

Physical Description

Although the tray 11 (FIG. 1) is smooth and continuous, for design and descriptive purposes it is divided into a planar surface 12 at the back (i.e., again, the end closest to the other components of the image-related device) and a three-dimensionally curved surface 13 at the front. As stated previously, the smooth and continuous curved and planar surfaces may have relatively small or minor surface disruptions such as cavities or throughholes that do not significantly affect the functionality of the tray.

The curved surface 13 (FIG. 2) is further conceptually divided, having two side regions 21 separated by a longitudinal central region 22. Extending each side region outward 21 is a corner 23. These corners 23 extend the curved surface 13 laterally beyond the longitudinal edges 27 of the planar surface 12.

The curved surface also includes a back boundary 24 and a front end 43. Located at the front end 43 is a handle 44 for gripping the tray 11 during installation and removal from—and stowing within—the main chassis of the image-related device.

The planar surface 12 has a front boundary 25, which smoothly blends with the back boundary 24 of the curved surface 13. The boundaries 24, 25, are aids to assist in describing the shape of the tray surface. The tray 11 is all one piece, and the boundaries 24, 25 between the smoothly blended planar surface 12 and subtly curved surface 13 cannot be perceived by the unaided eye or touch. The planar surface 12 also has a curved planar end 26.

Figure 5:
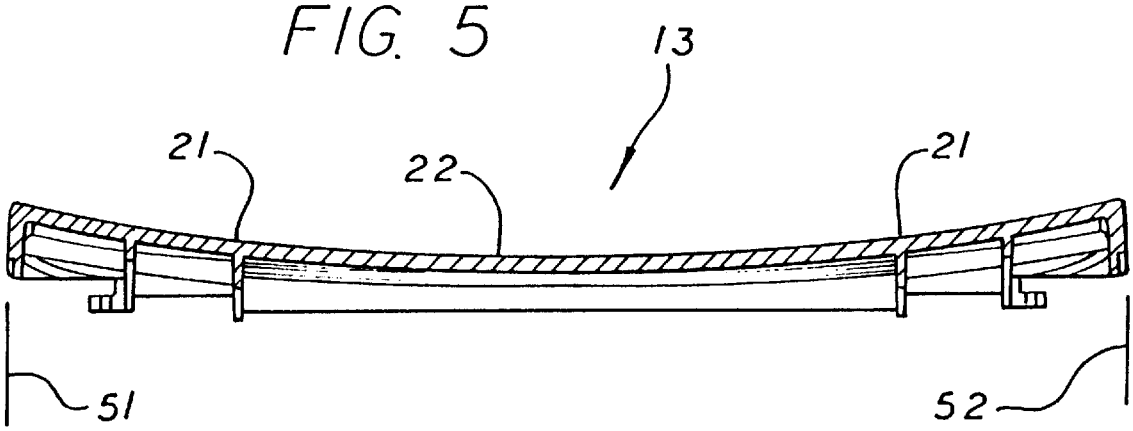
FIG. 5 is a sectional elevation of the curved surface of the FIG. 1 embodiment taken along the line 5—5 of FIG. 2 to show the transverse curve of the curved surface.
Figure 6:
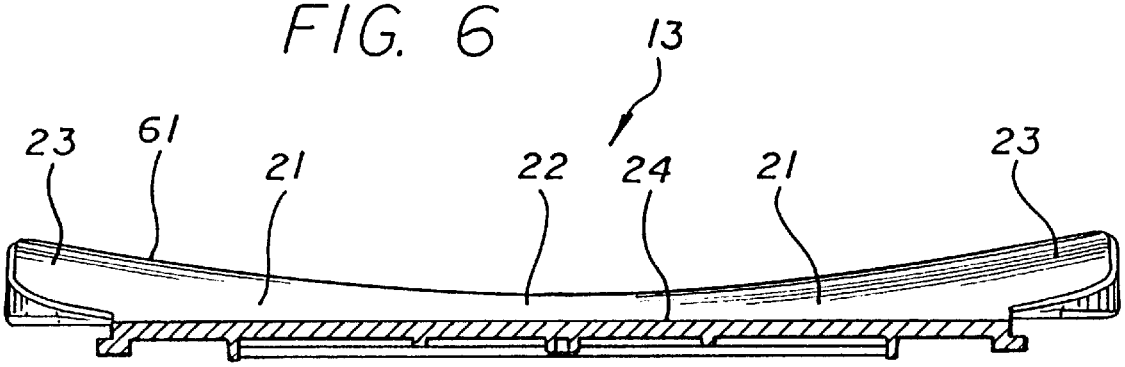
FIG. 6 is a sectional elevation of the planar surface of the FIG. 1 embodiment taken along the line 6—6 of FIG. 2 to show the flatness of the planar surface and the generally concave shape of the curved surface.

The curved surface 13 (FIGS. 5 and 6) is very generally concave in the transverse direction with its sides 21 curving upward from the central region 22 in a lateral direction. The corners 23 extend the side regions 21 outward to left and right, and continue the same general curved shape.

While concave transversely, the curved surface 13 (FIG. 3) is also curved longitudinally—i.e., the sides 21 curve upward from the boundary 24 in the longitudinal direction. The combined concave and upward curves result in a curved surface 13 (FIG. 6) that is concave at the far periphery 61 and gradually slopes downward to the boundary 24. A more-detailed description of the curved surface 13 is provided later in this document.

Figure 7:
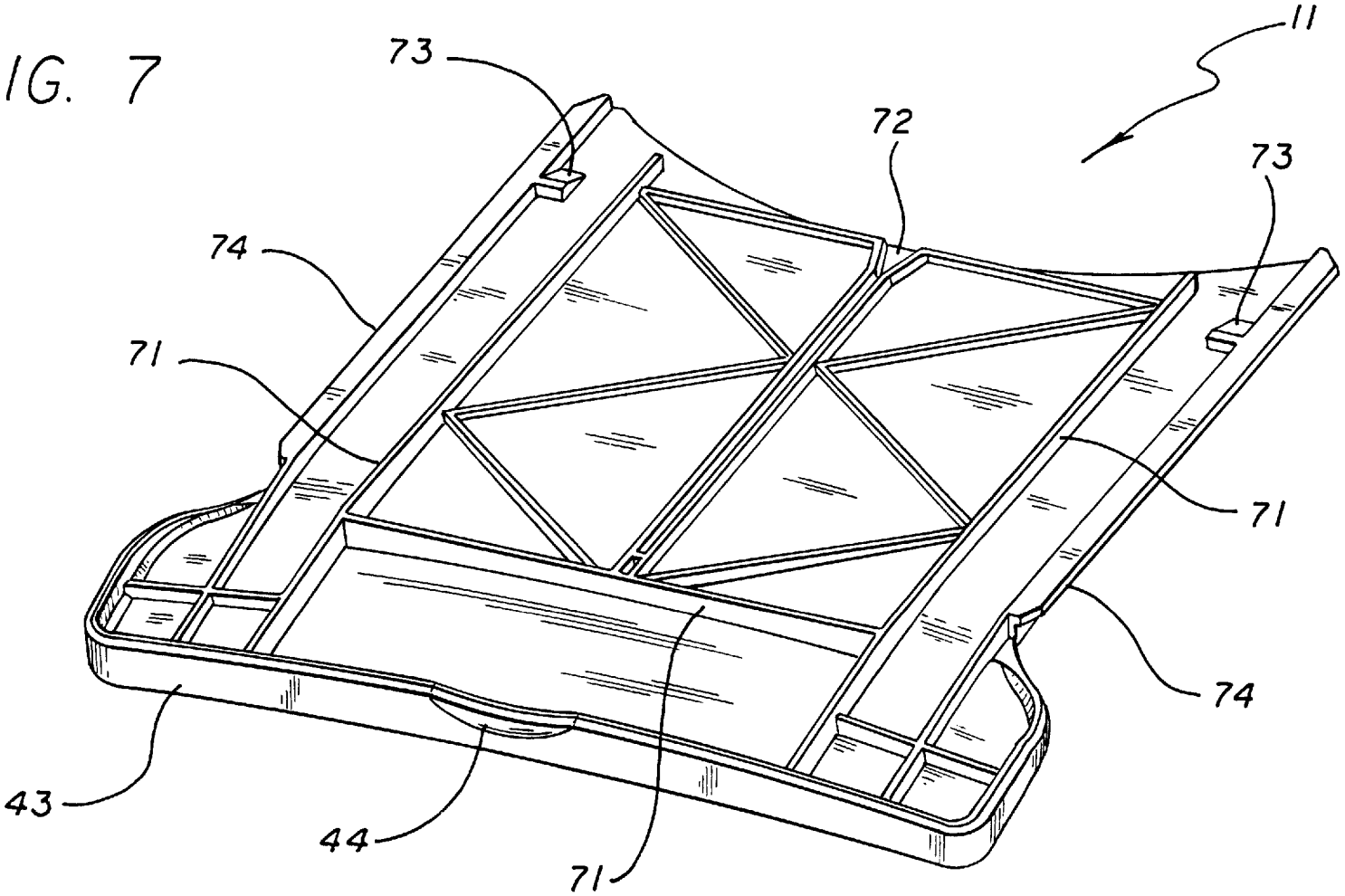
FIG. 7 is a perspective view of the bottom surface of the FIG. 1 embodiment.

The underside of the tray 11 (FIGS. 7 and 8) includes a pair of side guides 74 and a center guide rib 72. Near the end of each guide 74 is a stop 73. The side guides 74 and center guide rib 72 provide the means to guide the tray 11 in and out of the chassis during stowing. The stops 73 prevent the tray 11 from being inadvertently removed from the device chassis while the tray 11 is being extended from a stowed position.

Also on the underside is a pattern of support ribs 71. The arrangement, number and dimensions of the ribs 71 are selected to provide strength to the tray surface, while at the same time minimizing the amount of plastics required to form a tray.

Except in thickness, the tray 11 (FIG. 1) is smaller than a letter-size sheet of paper. As previously stated, this is made possible by the combined transverse and longitudinal curves of the curved surface 13. These curves impart rigidity to a sheet of medium so that the sheet can extend beyond the front end 43 of the tray without flopping—while at the same time avoiding adverse effects of strong curvature. Because of this feature the tray can be much smaller than the largest medium it is expected to handle, contrary to the requirements of many common trays.

Notably absent from the tray 11 are discrete side guards and a discrete longitudinal stop. As will be explained in the functional description which follows, the need for such items is eliminated by the manner in which our tray interacts with the medium it collects.

The tray as described above includes these approximate dimensions:

| MILLI-METERS | DIMENSION |
|---|---|
| 175 | distance between the planar surface left edge 41 (FIG. 2) and the planar surface right edge 28 |
| 182 | distance between the left guide outer edge 29 and the right guide outer edge 42 |
| 6 | distance from the planar surface top 32 (FIG. 3) to the guide bottom 31 |
| 250 | distance from the planar edge 45 (FIG. 2) to the curved surface extreme point 46 |
| 215 | distance between the left corner edge 51 (FIG. 5) and the right corner edge 52 |
| 170 | distance from the planar edge 45 (FIG. 8) to the guide end 83 |

-continued

| MILLI-METERS | DIMENSION |
|---|---|
| 169 | distance between the right guide inner edge 81 and the left guide inner edge 82. |

Specific Physical Description

The curved surface of the tray is geometrically modeled using B-spline curves. A general explanation of these curves and surfaces is available in Bartels et al., *An Introduction to Splines For Use In Computer Graphics & Geometric Modeling* (1987).

Figure 1A:
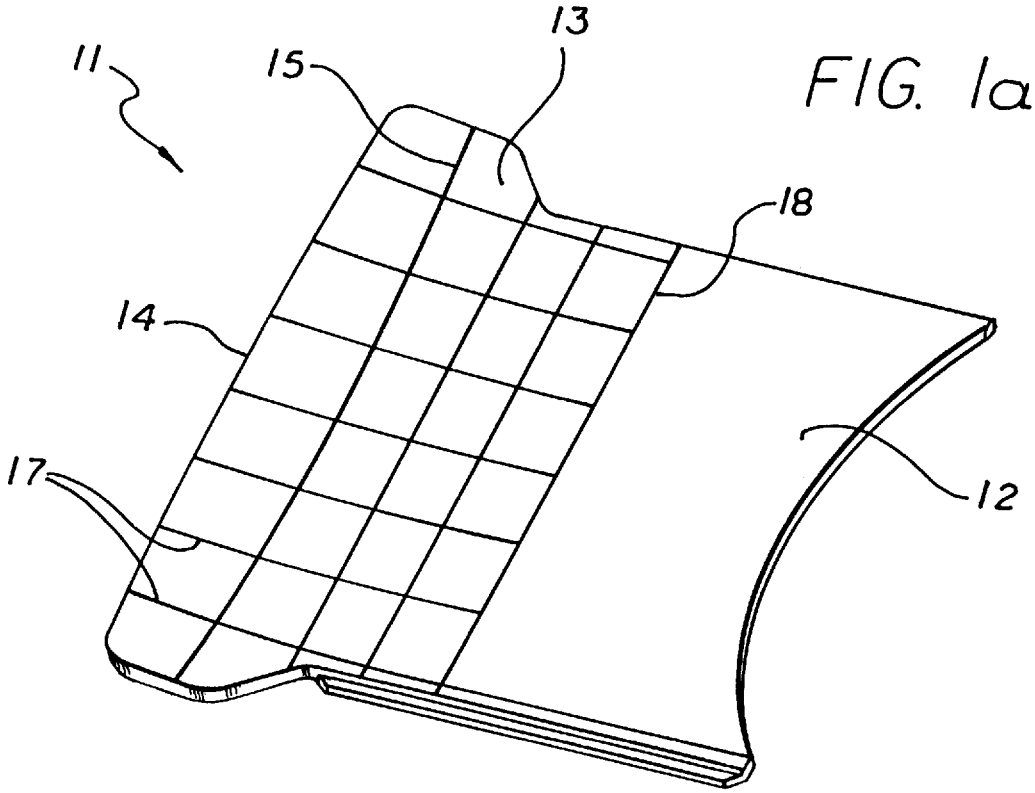
FIG. 1*a* is another perspective view of the top surface of the FIG. 1 embodiment depicting a very general representation of a set of transverse curves and longitudinal matchline curves that may be used to define the curved surface

We model the curved surface 13 (FIG. 1*a*) by creating a meshed surface using the following curves: a top polynomial curve 14, an intermediate polynomial curve 15, a straight line 16, and a set of matchline curves 17. The surface is then formed by lofting the top polynomial curve 14, along the paths of the set of matchline curves 17, to the intermediate polynomial curve 15 and finally to the straight line 16. While we prefer lofting to form the tray surface, other known techniques such as extrusion, ruling and sweeping are comparably effective and are to be understood as within the scope of our invention.

The selection of curves is determined by the operating parameters of a specific image-related device as detailed in the following functional description. The curves result in a surface 13 (FIG. 1*a*) that longitudinally curves upward to intercept medium emerging from the device. The surface also curves transversely to impart sufficient rigidity to the medium so it can extend over the front end 43 of the tray 11 without flopping.

Our selection of longitudinal and transverse curves gives the surface a gentleness of curve to restrain the leading-edge portion of the medium from curling too much. It is desirable to keep the transverse curve of the surface to a minimum to limit the tightness and longitudinal extent of the transverse curl of the medium. Likewise, it is desirable to keep the longitudinal curve to a minimum to limit the longitudinal curl of the medium.

Minimizing the curves in this way is important for several reasons. First, in minimizing the steepness of the surface curves, sheets of print medium are better able to conform to the surface of the tray 11. Accordingly, a greater number of sheets can be neatly stacked.

Second, as previously mentioned, in minimizing the extent of the curl in the medium we minimize residual curl. This is particularly relevant when the tray 11 is part of a liquid-ink image-processing device in which drying ink usually leaves a residual curl in those portions of the medium that are curled while drying.

The surface formed by the above-described lofting technique is substantially defined by Eqs. 1 through 6, in conjunction with the coefficients of Table 1, as previously stated. The nonuniform B-spline surface is formed by summing over the products of the basis functions $\underline{N}_{i,k}(u)$ (Eq. 3) and $\underline{N}_{j,l}(v)$ (Eq. 5), where $\underline{u}$ and $\underline{v}$ are parametric variables in two directions along the surface.

The values of $\underline{t}$ are provided by $\underline{T}_{knot(u)}$ (Eq. 4) and $\underline{T}_{knot(v)}$ (Eq. 6). These knot vectors are appropriate for any open nonuniform B-spline of order $\underline{k}$ and degree $\underline{k}-1$. Each $\underline{T}_{knot}$ begins with a number of $\underline{t}_{min}$ knots equal to the order, $\underline{k}$ or $\underline{l}$, of the basis function and ends with the same number of $\underline{t}_{max}$ knots. The resultant series of knots are nonuniformily spaced along the parameter t. The total number of knots for each $T_{knot}$ is the summation of the order, k or l, and the number of control vertices, n or m, respectively. For our surface the number of knots in the u direction is eighteen and sixteen in the v direction.

Figure 1B:
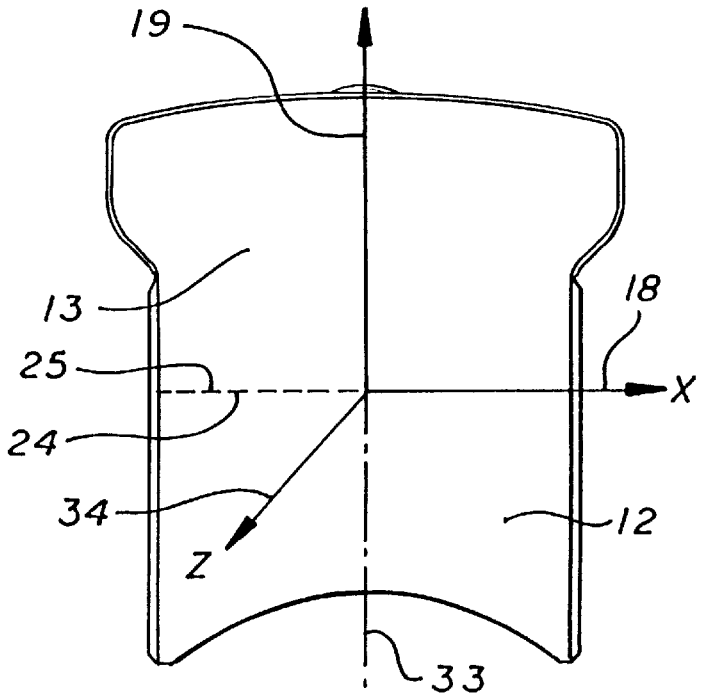
FIG. 1*b* is a plan view of the top surface depicting the x, y, z coordinate system for locating the control vertices of the FIG. 1 embodiment.

Listed in Table 1 are values of control vertices, $V_{i,j}$, for the u and v directions. There are twelve (m=12) groups of thirteen (n=13) rows; each row lists the x, y, and z coordinates of a vertex. The x-axis 18 (FIG. 1*b*) is coincident with the boundaries 24, 25 of the curved surface 13 and the planar surface 12. Likewise, the y-axis 19 (FIG. 1*b*) is coincident with the longitudinal axis of symmetry 33. The z-axis 34 is normal to the plane of the paper. These vertices provide a three-dimensional representation of the best implementation of the invention found so far.

Once the surface is defined a three-dimensional computer model advantageously may be formed—for example using a computer-aided design (CAD) system. The tray mold, from which one-piece image-receiving trays will be cast, is generated by interrogating the model at fine positional increments, and passing the results to a numerically controlled machining process.

Functional Description

An image-related device in accordance with our invention has the following operating parameters:

Image processing type - liquid ink
Medium type - paper, glossy, and transparency
Largest output - legal-size medium
Exit velocity - 6½ to 12 cm (2.6 to 4.7 inches) per second

| | leading edge | | trailing edge | |
|---|---|---|---|---|
| | side | center | side | center |
| Ejection angles (in degrees): | | | | |
| glossy medium | 20 | 0 | 3 | 6 |
| transparency medium | 20 | 0 | 3 | 6 |
| 20-pound legal size | 20 | 4 | 5 | 6 |
| 20-pound letter size | 20 | 4 | 10 | 9 |
| Ejection height (in cm): | | | | |
| glossy medium | 3.2 | 3.0 | 4.5 | 2.5 |
| transparency medium | 3.2 | 3.0 | 4.5 | 2.5 |
| 20-pound legal size | 5.8 | 4.8 | 4.5 | 3.2 |
| 20-pound letter size | 5.8 | 4.8 | 4.5 | 3.2 |
| Pinch point - 4.5 cm above planar surface | | | | |

By "side angle" (first and third columns above) we mean the lateral angle which lateral tangents to the longitudinal side regions of the medium, near the outboard edges, make with the horizontal—at the exit slot. By "central angle" (second and fourth columns) we mean the longitudinal angle which the central region of the medium makes relative to the horizontal, also at the exit slot.

By "ejection height" we mean the distance between the tray surface and the medium, measured when the medium is almost completely exited from the device. The leading edge is measured from the curved surface, while the trailing edge is measured from the planar surface at the pinch point. The "pinch point" is the point at which the wheels of the kickout mechanism, located at the outboard edges of the exit slot, engage to drive sheets of medium from the device.

Based on these parameters our tray is sized and shaped, as previously described, and positioned relative to the pinch point of the kickout mechanism to collect and stack medium as follows. For a device operating at approximately 6½ cm (2.6 inches) per second the leading-edge portion of an emerging sheet extends over and above the planar surface 12 without contacting the surface. As the sheet continues to emerge, the leading edge approaches the curved surface 13 of the tray—while the trailing-edge portion now extends over and above the planar surface 12.

Before the trailing edge of the sheet is kicked out (i.e., completely exited from the kickout mechanism), the tray—with its upward sloping curved surface 13—intercepts the leading-edge portion of the sheet. Forward motion of the sheet is impeded, and the leading-edge portion conforms to the shape of the curved surface 13. The trailing-edge is then kicked out and floats down onto the planar surface 12. Thus there is a slight time differential of between the leading edge conforming to the curved surface and the trailing edge conforming to the planar surface.

For a device operating at approximately 12 cm (4.7 inches) per second the just-described interaction between the tray surface and exiting medium is slightly altered. At this increased exit velocity the leading-edge portion of the sheet travels above the tray surface for a greater distance before being intercepted by the curved surface. As a result the trailing edge is typically kicked out before the leading edge contacts the curved surface. Thus the time differential between the leading-edge portion and the trailing-edge portion landing on the tray is very slight with both portions of the sheet landing at approximately the same time.

At either exit velocity the sheet conforms to the surface of the tray and thereby functions as the tray surface with regard to the next ejected sheet. The above-described interaction continues for subsequent sheets, and the end result is a neat, evenly stacked pile of medium.

The type of medium also affects the interaction between the tray surface and the medium. Plain paper is rigid and travels above the tray surface for a greater distance before contacting the curved surface, than does transparency, which is more flexible and begins to slope downward when emerging from the kickout mechanism. The tendency of transparency to slope and thereby contact the curved surface sooner than paper can be seen in the ejection height data provided in the list of operating parameters. Upon complete exit the leading edge of a sheet of paper is between 4.8 and 5.8 centimeters above the tray surface. For transparency, the leading edge is between 3.0 and 3.2 centimeters above the surface.

Our device is optimized to collect and stack all required types of medium exiting at either 6½ or 12 cm per second. Of course there is a limit to the number of sheets that can be effectively stacked before the curved surface begins to lose shape, i.e. flatten out. In practice the device has been able to successfully stack one-hundred sheets of legal- or letter-size paper, transparency, or glossy.

As previously mentioned, the above-described interaction between the tray surface and the emerging sheets is particularly beneficial in liquid-ink devices. The way in which the sheets leave the device and land down onto the tray prevents just-exited sheet from sliding along the already-ejected sheets and thereby reduces the possibility of smearing.

Other inherent benefits of the tray based on the interaction between the tray surface include the absence of a discrete longitudinal stop. In our tray, the curved surface 13 acts in lieu of a stop when it intercepts the leading-edge portion of the sheet and impedes the motion of the sheet. In addition, due to the downward landing of the sheets there is no need for side guards to guide the medium along the length of the tray—as is common in devices which output medium in a manner that slides the medium from back to front along the tray surface The scope of our invention is not limited to an image-related device having the above-described operating parameters. Given a different set of operating parameters, a person skilled in the art can redefine and readjust the curves to design a tray that duplicates the operation of our preferred embodiment.

The foregoing detailed disclosure is intended as merely exemplary, and not to limit the scope of the invention—which scope is to be determined by reference to the appended claims.

What is claimed is:

1. An image-medium receiving tray for collecting and stacking sheets of image medium from an image-related device that comprises at least one of a printer, copier, scanner or facsimile machine; said image-medium receiving tray comprising:

a curved surface having a longitudinal central region, two side regions, and a boundary, the side regions substantially smoothly curving upward from the central region in a lateral direction, and upward from the boundary in a longitudinal direction; and means for linking the curved surface to such image-related device.

2. The image-medium receiving tray of claim 1, wherein:

the linking means comprise a generally planar surface having a boundary; and the planar surface and the curved surface substantially smoothly blend together at their respective boundaries.

3. The image-medium receiving tray of claim 2, wherein:

combined longitudinal length of the curved surface and the planar surface is shorter than letter-size paper;

the curved surface and the planar surface are for supporting such sheets; and said image-medium receiving tray comprises no other means for supporting such sheets.

4. The image-medium receiving tray of claim 3, wherein:

lateral width of the planar surface is narrower than letter-size paper.

5. The image-medium receiving tray of claim 4, wherein:

lateral width of the curved surface is narrower than letter-size paper.

6. The image-medium receiving tray of claim 4, having no longitudinal image-medium stop.

7. The image-medium receiving tray of claim 2, wherein:

the planar surface has a maximum width; and the curved surface further comprises two corners substantially smoothly curving upward from their respective side regions in a lateral direction, and extending laterally beyond the maximum width of the planar surface.

8. The image-medium receiving tray of claim 7, wherein:

the curved surface has a top polynomial curve at a far periphery and a straight line at its boundary; and the curved surface interconnects the top polynomial curve with the straight line along paths of a set of matchline polynomial curves.

9. The image-medium receiving tray of claim 8, wherein:

the top polynomial curve is at least a quadratic B-spline and the matchline polynomial curves are at least quadratic B-splines.

10. The image-medium receiving tray of claim 1, wherein:

the curved surface has a top polynomial curve at a far periphery and a straight line at the boundary; and the curved surface interconnects the top polynomial curve with the straight line along paths of a set of matchline polynomial curves.

11. The image-medium receiving tray of claim 10, wherein:

the top polynomial curve is at least a quadratic B-spline and the matchline polynomial curves are at least quadratic B-splines.

12. An image-medium receiving tray for collecting and stacking sheets of image medium from an image-related device that comprises at least one of a printer, copier, scanner or facsimile machine; said image-medium receiving tray comprising:

a curved surface defined substantially by the following equations in conjunction with Table 1:

$$\underline{Q}(\underline{u}, \underline{v}) = \sum_{i=0}^{n-1} \sum_{j=0}^{m-1} \underline{v}_{i,j} \underline{S}_{i,j}(\underline{u}, \underline{v}) \quad \text{(Eq. 1)}$$

where $\underline{V}_{i,j}$ are coordinates of control vertices, $$\underline{S}_{i,j}(\underline{u}, \underline{v}) = \frac{\underline{w}_{i,j}\underline{N}_{i,k}(\underline{u})\underline{N}_{j,l}(\underline{v})}{\sum_{i=0}^{n-1} \sum_{j=0}^{m-1} \underline{w}_{i,j}\underline{N}_{i,k}(\underline{u})\underline{N}_{j,l}(\underline{v})}, \quad \text{(Eq. 2)}$$

$\underline{w}_{i,j}$ being a weight function, $$\underline{N}_{i,k}(\underline{u}) = \frac{(\underline{u} - \underline{u}_i)\underline{N}_{i,k-1}(\underline{u})}{\underline{u}_{i+k-1} - \underline{u}_i} + \frac{(\underline{u}_{i+k} - \underline{u})\underline{N}_{i+1,k-1}(\underline{u})}{\underline{u}_{i+k} - \underline{u}_{i+1}} \quad \text{(Eq. 3)}$$

is a basis function in a $\underline{u}$ direction, where first-order basis functions are $$\begin{aligned} \underline{N}_{i,1}(\underline{u}) &= 1 \text{ if } \underline{u}_i \leqq \underline{u} < \underline{u}_{i+1} \\ &= 0 \text{ otherwise} \end{aligned}$$

and having values of $\underline{u}$ according to $$\underline{T}_{knot(u)} = [\underline{u}_{min}, \underline{u}_{min}, \ldots \underline{u}_{min}, \underline{u}_k, \ldots \underline{u}_{M-k-1}, \underline{u}_{max}, \underline{u}_{max}, \ldots \underline{u}_{max}] \quad \text{(Eq. 4)}$$

where a total number of $\underline{u}$ values is $\underline{M}=\underline{k}+\underline{n}$, and the number of $\underline{u}_{min}$ and $\underline{u}_{max}$ is equal to $\underline{k}$, $$\underline{N}_{j,1}(\underline{v}) = \frac{(\underline{v} - \underline{v}_j)\underline{N}_{j,l-1}(\underline{v})}{\underline{v}_{j+l-1} - \underline{v}_j} + \frac{(\underline{v}_{j+l} - \underline{v})\underline{N}_{j+1,l-1}(\underline{v})}{\underline{v}_{j+l} - \underline{v}_{j+1}} \quad \text{(Eq. 5)}$$

is a basis function in a $\underline{v}$ direction where the first-order basis functions are $$\begin{aligned} \underline{N}_{j,1}(\underline{v}) &= 1 \text{ if } \underline{v}_j \leqq \underline{v} < \underline{v}_{j+1} \\ &= 0 \text{ otherwise} \end{aligned}$$

and having values of $\underline{v}$ according to $$\underline{T}_{knot(v)} = [\underline{v}_{min}, \underline{v}_{min}, \ldots \underline{v}_{min}, \underline{v}_1, \ldots \underline{v}_{M-l-1}, \underline{v}_{max}, \underline{v}_{max}, \ldots \underline{v}_{max}] \quad \text{(Eq. 6)}$$

where a total number of $\underline{v}$ values is $\underline{M}=\underline{l}+\underline{m}$, and the number of $\underline{v}_{min}$ and $\underline{v}_{max}$ is equal to $\underline{l}$, $\underline{n}$ is a number of control vertices in the $\underline{u}$ direction, $\underline{m}$ is a number of control vertices in the $\underline{v}$ direction, $\underline{k}$ is an order of the basis function in the $\underline{u}$ direction, l is an order of the basis function in the v direction and means for linking the curved surface to such image-related device.

13. An image-related device for handling sheets of image medium and for incrementally scanning images thereon or forming images thereon, or both; said device comprising:

means for processing an image on each such sheet;

supply means for supplying multiple such sheets sequentially to the image-processing means;

a kickout mechanism for removing such sheets from the image-processing means; and an image-medium receiving tray for receiving such sheets from the kickout mechanism and collecting and stacking such sheets, said tray including:

means for transversely curling a leading-edge portion of each such sheet, and means for flattening a trailing-edge portion of each such sheet.

14. The device of claim 13, wherein:

the image-processing means comprise wet-process means for forming images on each such sheet by aggregation of liquid ink.

15. The device of claim 14, wherein:

the image-medium receiving tray is positioned and oriented relative to the kickout mechanism so that the curling means intercept the leading-edge portion of each such sheet first and thereafter the flattening means receive the trailing-edge portion of each such sheet.

16. The device of claim 15, wherein:

the curling means comprise a curved surface having a longitudinal central region, two side regions, and a boundary, the side regions substantially smoothly curving upward from the central region in a lateral direction and upward from the boundary in a longitudinal direction;

the flattening means comprise a generally planar surface having a boundary; and the curved surface and the planar surface substantially smoothly blend together at their respective boundaries.

17. The device of claim 16, wherein:

the curved surface has a top polynomial curve at a far periphery and a straight line at its boundary; and the curved surface interconnects the top polynomial curve with the straight line along paths of a set of matchline polynomial curves.

18. The device of claim 17, wherein:

the top polynomial curve is at least a quadratic B-spline and the matchline polynomial curves are at least quadratic B-splines.

19. An image-medium receiving tray for controlling contouring and reception of image-medium sheets from an image-related device that operates using a wet process:

said tray comprising a front end remote from such image-related device; and said tray designed by a method comprising the steps of:

establishing a set of transverse curves and a set of longitudinal matchline curves to generally define a part of a tray surface, wherein the transverse curves and the longitudinal matchline curves are at least quadratic B-spline curves; and interconnecting adjacent ones of the transverse curves along paths of the longitudinal matchline curves to further define said part of the tray surface;

adjusting the transverse curves and the longitudinal matchline curves to further define said part of the surface as curved, for:

curling a leading-edge portion of each such image-medium sheet to give the leading-edge portion sufficient rigidity for extending beyond the front end, but restraining both tightness and longitudinal extent of said curling so that such image-medium sheet is not strongly curled where it is wet-test, and so tends not to retain a residual curl; and defining a generally planar part of the tray surface for flattening a trailing-edge portion of each such sheet.

* * * * *